US006547165B2

(12) United States Patent
Goodwin et al.

(10) Patent No.: US 6,547,165 B2
(45) Date of Patent: Apr. 15, 2003

(54) EXTENSION HOLDER FOR SPRAY, CAULK AND PAINT DEVICES

(76) Inventors: Wallace M. Goodwin, 8050 Emerson St., Denver, CO (US) 80229; Neil A. Goncalves, 564 Co Rd. 222, Durango, CO (US) 81301

( * ) Notice: Subject to any disclaimer, the term of this patent is extended or adjusted under 35 U.S.C. 154(b) by 0 days.

(21) Appl. No.: 09/811,658

(22) Filed: Mar. 20, 2001

(65) Prior Publication Data

US 2002/0134864 A1 Sep. 26, 2002

(51) Int. Cl.[7] ..... B05B 15/06

(52) U.S. Cl. ..... 239/532; 239/280; 239/281; 239/578

(58) Field of Search ..... 239/532, 280, 239/280.5, 281, 587.1, 587.5, 578

(56) References Cited

U.S. PATENT DOCUMENTS 1,511,361 A 10/1924 Paasche
1,745,972 A 2/1930 Beck
4,023,711 A * 5/1977 Sena ..... 222/174
4,457,472 A 7/1984 Geberth, Jr.
4,479,599 A * 10/1984 Conrad ..... 227/156

FOREIGN PATENT DOCUMENTS

DE 22 30 148 7/1978

* cited by examiner

*Primary Examiner*—C Kim
(74) *Attorney, Agent, or Firm*—Dorr, Carson, Sloan & Birney P.C.

(57) ABSTRACT

A device for mounting and controlling a paint spray gun, caulking gun, or similar device on an elongate extension member in order to work on high or hard to reach surfaces without a ladder or scaffold. The device includes a head to which a standard gun can be releasably attached, a pivot adjustment to point the gun in the desired direction, and a trigger cam and strap to move the gun trigger, and a trigger pole rotated by the hand of the operator and connected to the trigger cam. The device allows for fine adjustment of the gun trigger and counteracts the gun kickback when it sprays, thus producing uniform paint spraying.

9 Claims, 8 Drawing Sheets

EXTENSION HOLDER FOR SPRAY, CAULK AND PAINT DEVICES

BACKGROUND

1. Field of Invention

The invention relates to a universal extension holder for paint sprayer devices, caulking guns, paint applicator devices and similar devices, the use of which enables an operator to spray paint, caulk, etc. in high or difficult to reach areas without the use of ladders, scaffolding or other elevation of the operator.

2. Description of Prior Art

For over 75 years, inventors have been attempting to deal with the problem of using paint sprayers, caulking guns and the like in high or hard to reach places above or below the operator. In this Application, only the situation with paint sprayers will be discussed, but similar considerations are involved with caulking guns, brush devices for applying paint, etc. The problem may involve painting a vertical surface, or a horizontal surface, above or below the head of the operator. The use of ladders, scaffolding, etc. to raise the operator to the work surface is slow, expensive and dangerous. Many devices have been invented to deal with this problem. Representative of the related art are the following patents. U.S. Pat. No. 1,511,361, Oct. 14, 1924, to J. A. Paasche, involved a custom-made spray head on an extension pole. However, the extension pole was not an off-the-shelf item, but rather was a custom made tube with elaborate internal tubing which was heavy, difficult to clean, and did not attach to standard sprayers. U.S. Pat. No. 1,745,972, Feb. 4, 1930, to L. W. Beck, used a standard spray gun but not a standard extension pole, had a large number of parts, and controlled the spray gun trigger by means of a complicated system involving a hand lever at the operator's level. The motion of the lever was communicated up to the spray gun trigger by a cable, the tension on which required frequent adjustment when the spray head was set at various angles. Other patents such as German Patent DE 22 30 148B, Jul. 13, 1978, to G. Schneider, did not use an off-the-shelf extension tube, but rather one with an elaborate system of cable and pulleys to operate the trigger of the sprayer. U.S. Pat. No. 4,457,472, Jul. 3, 1984, to J. D. Geberth, Jr., involved a custom made extension pole and handle and a very complex reel and cable system to adjust the control cable for various lengths of the extension pole. All of these devices were complex to make and operate, and in most cases, did not use standard off-the-shelf items, as far as sprayers and extension poles are concerned.

SUMMARY OF INVENTION

The invention comprises a device for mounting a paint sprayer, caulking gun or similar device on an extension pole or other elongate member for use in high or difficult to reach locations, and a control mechanism for the paint sprayer, etc. The paint sprayer is easily detachable from a holder, and the holder is adjustable so that the sprayer can be pointed in different directions. A trigger extension mechanism enables the operator to accuragely control the trigger of the paint sprayer, etc. mounted on the extension pole.

OBJECTS AND ADVANTAGES

The objects of the present invention are:

1. To enable an operator to use and control a paint sprayer, caulking gun or similar device in high or difficult to reach places without the use of a ladder, scaffolding or similar device to elevate the position of the operator, thus saving time and increasing safety.
2. To enable an operator to attach an off-the-shelf paint spray device or similar device, without modification, to an off-the-shelf paint extension pole.
3. To provide a quick method of attaching the sprayer to, and releasing it from, the extension pole.
4. To enable an operator to control the trigger of the sprayer from the ground or similar comfortable position, and to reliably control how much liquid the sprayer releases, thus improving spray uniformity.
5. To counter the kickback force of the sprayer when in operation by the use of a unique rotary trigger mechanism which exerts a stabilizing force and pressure on the extension pole and gun, increasing the positioning accuracy of the device and increasing spray uniformity. The rotary mechanism, when engaged, acts like a support that can be positioned appropriately for the target to resist the reaction forces that result from the spray valve and nozzle opening.
6. To provide a convenient, easily adjustable, telescoping pole for controlling the trigger mechanism.
7. To provide a trigger control mechanism which is simple to produce, and which does not break or jam as do other trigger control mechanisms.
8. To provide a device which is safe, simple and easy to operate and which does not require any special tools to set up or adjust.
9. To provide a device which can be made of simple parts which can be machined from metal or formed from plastic by injection molding.
10. To provide a trigger control mechanism which can be easily adapted for left or right handed operators.
11. To provide a trigger mechanism which allows for cams of different shapes to match the trigger characteristics of the spray gun, so that the trigger of the sprayer can be operated in a controlled way with many different degrees of liquid release rate.
12. To provide a paint sprayer extender adapted for convenient use and control by the operator through the use of a waist-belt harness or similar device to facilitate mobility of the operator while supporting the device.

Still further objects and advantages will become evident from the detailed description of the invention and the drawings.

DRAWING FIGURES

FIG. 1 shows the device being used by an operator to paint the higher portions of a building. The standard off-the-shelf paint extender pole has its lower end resting in the waist-belt harness. The operator's left hand is controlling the trigger pole.

REFERENCE NUMERALS IN DRAWINGS

Figure 1:
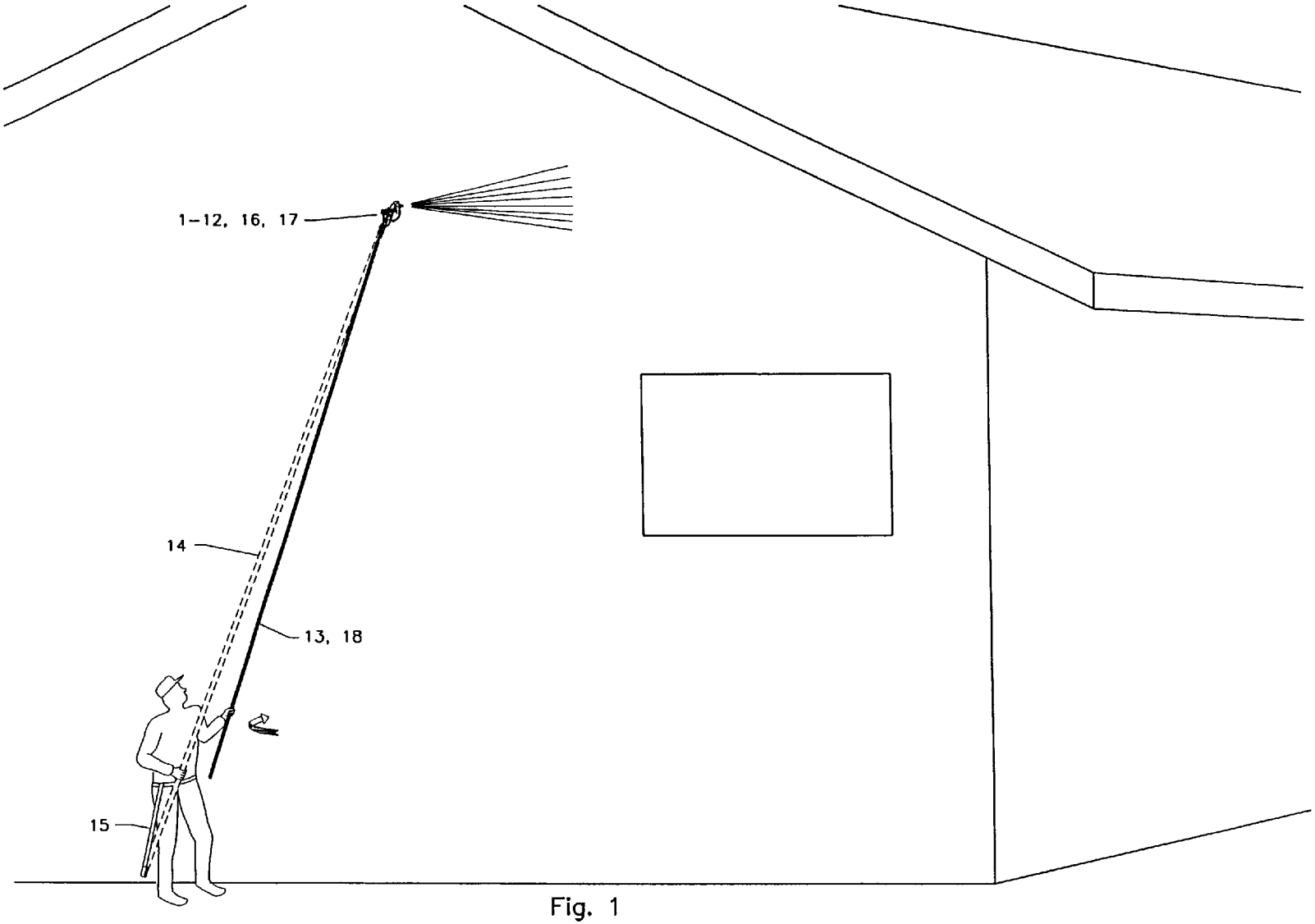

1 apparatus head
2 apparatus base
3 nylon bushings
4 trigger cam
5 cam set screw
6 pivot shaft
7 flex-shaft
8 trigger pull strap
9 Velcro retainer strap
10 paint gun (or caulk gun)
11 pivot adjuster
12 retainer screws
13 adjustable length trigger pole w/coupler
14 paint extension pole
15 pole harness
16 curved head cradle
17 head ears
18 trigger pole pins

DETAILED DESCRIPTION OF THE DRAWINGS

Figure 2:
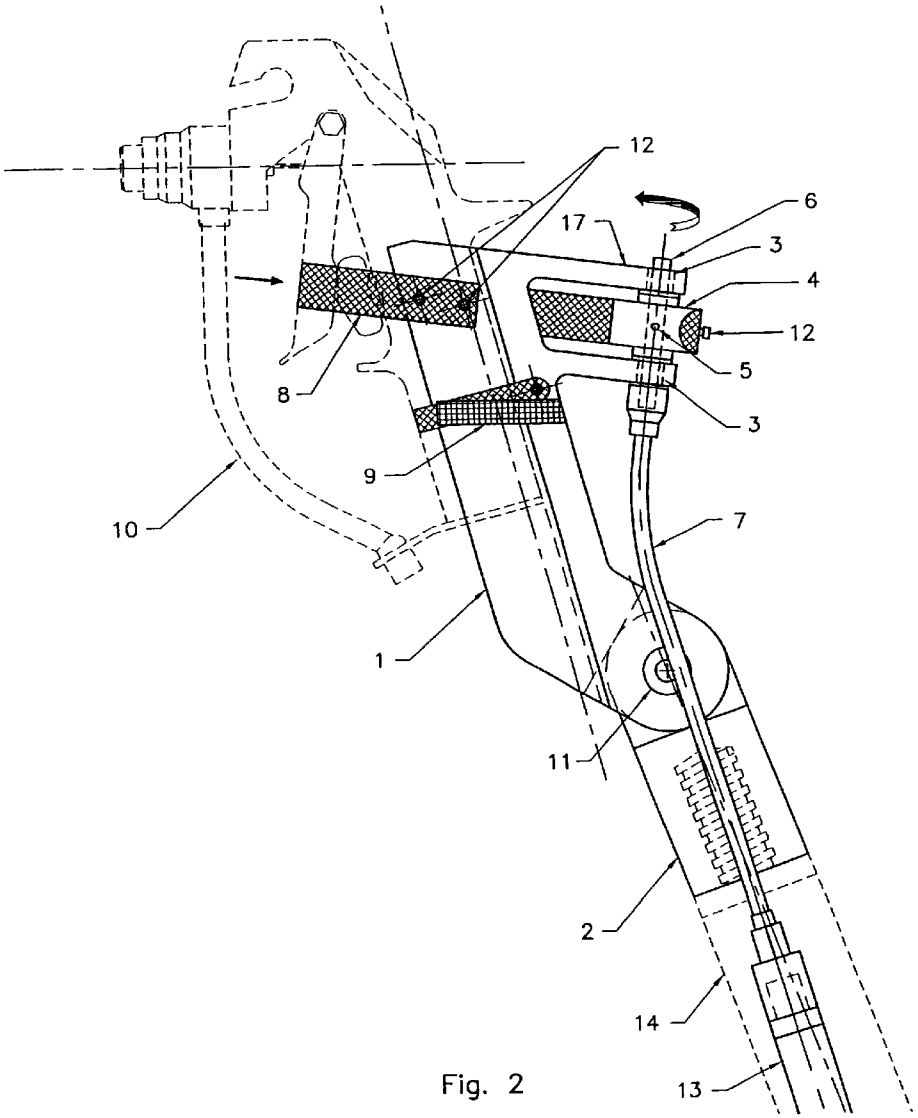
FIG. 2 shows a standard paint sprayer (dotted lines) attached to the device by means of a Velcro retainer strap, and the trigger of the sprayer connected to the trigger control mechanism of the device. This Figure also shows the device mounted on a standard off-the-shelf paint extender pole and the telescoping trigger pole.
Figure 3:
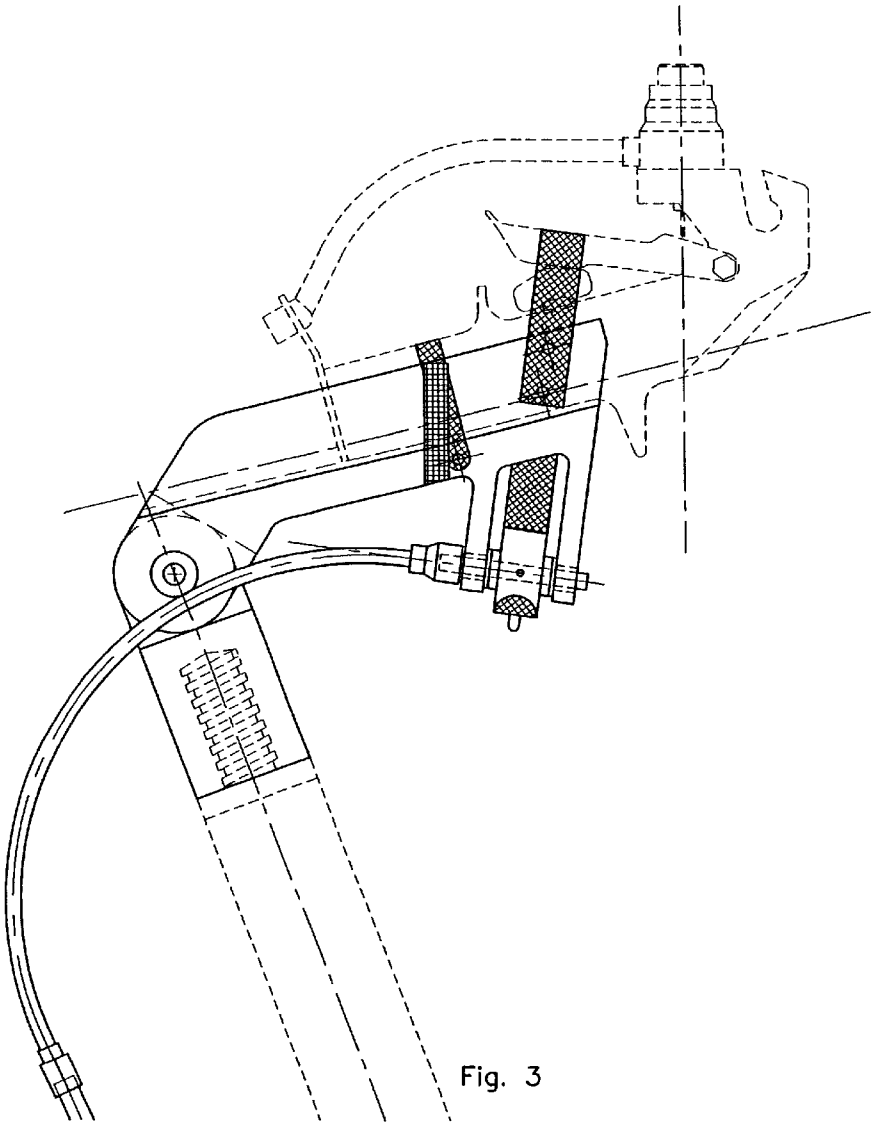
FIG. 3 shows how the device can pivot to allow the direction in which the sprayer is pointed to be generally parallel to the extender pole.
Figure 4:
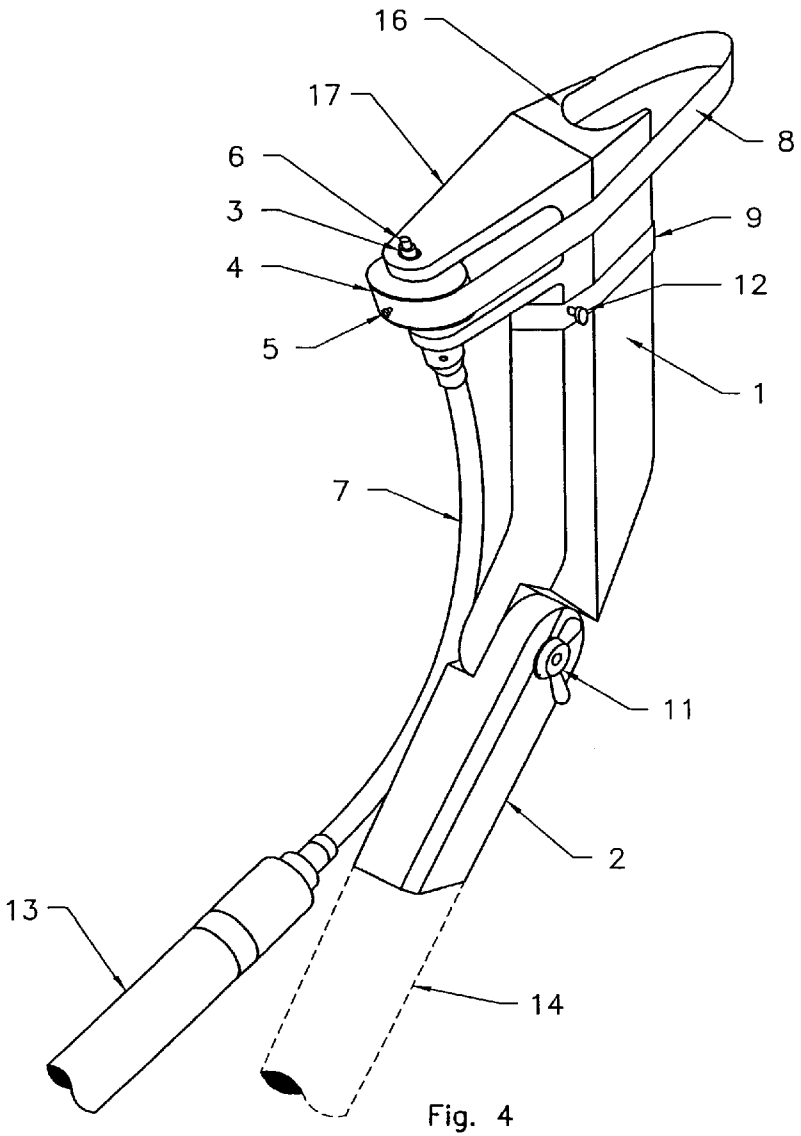
FIG. 4 shows the curved cradle of the device head into which the sprayer can fit and be secured by the Velcro retainer strap. It also shows the trigger pull strap, which presses against the sprayer trigger.
Figure 6:
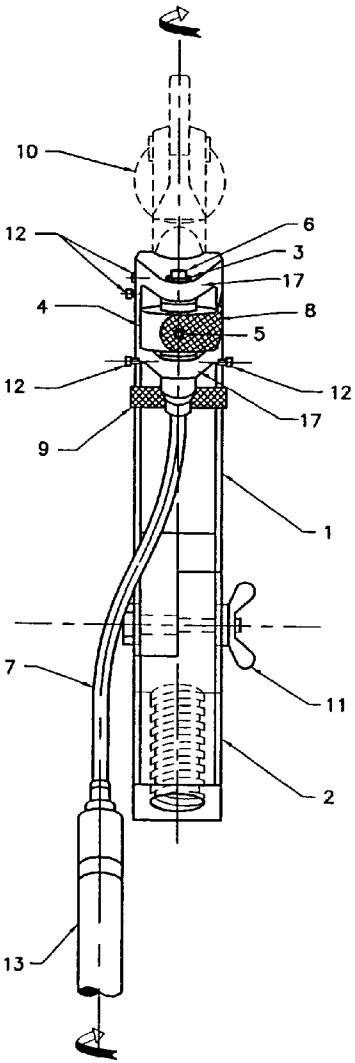
FIG. 6 is a rear view of a sprayer (dotted lines) in position in the cradle of the device head, with the trigger control strap attached to the trigger control cam, which is in turn connected by means of a flex-shaft coupling to the trigger control rod.
Figure 5:
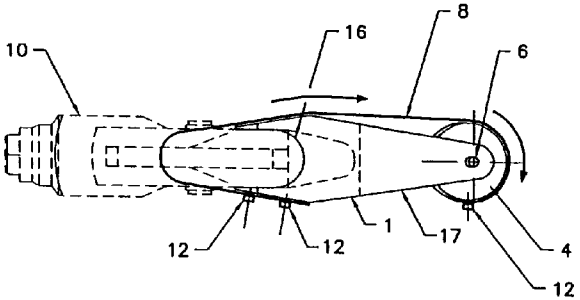
FIG. 5 is a top view showing a sprayer (dotted line) nestled in the curved cradle of the device head, with the trigger pull strap in contact with the sprayer trigger.
Figure 7:
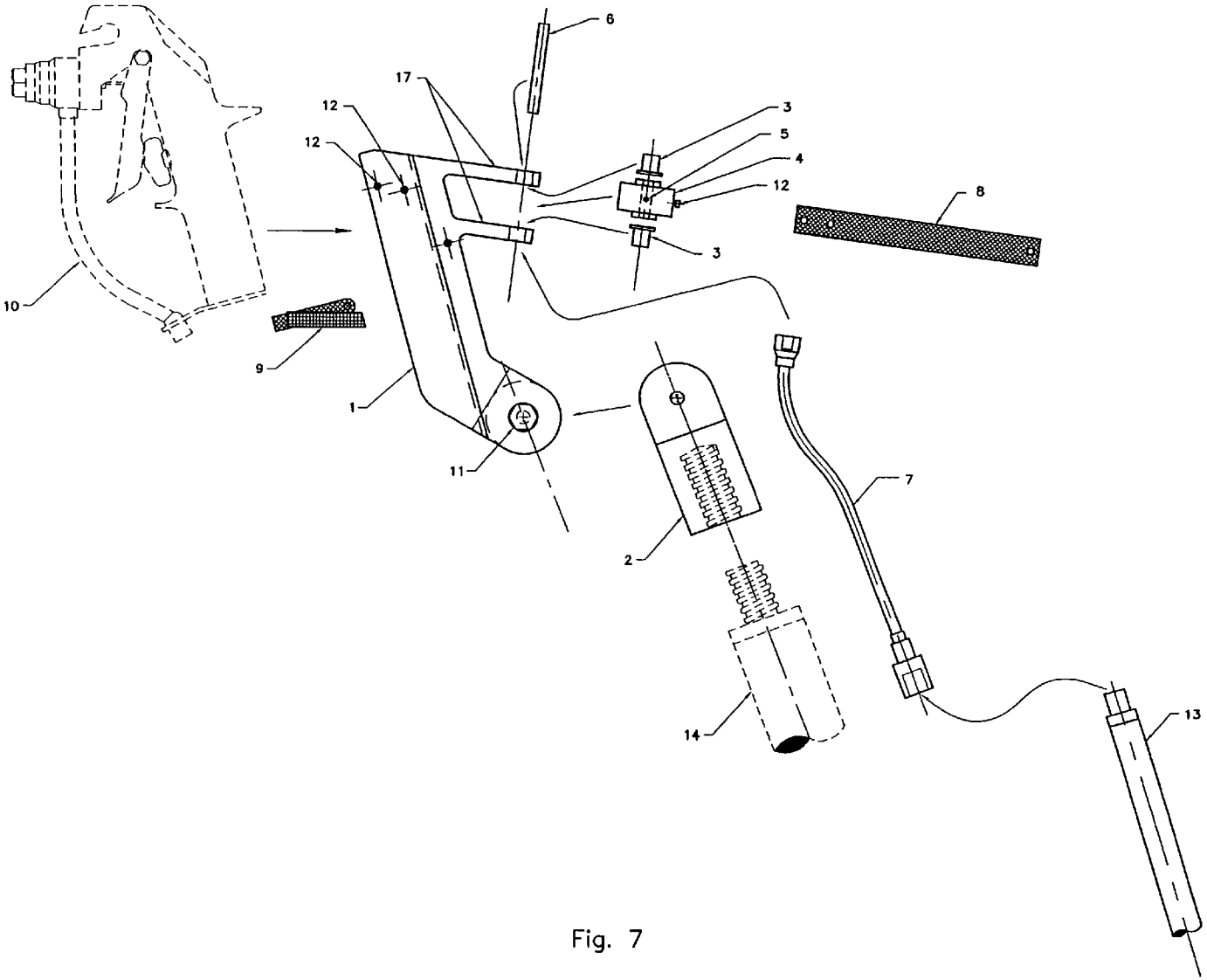
FIG. 7 shows detail of the trigger pull strap, the trigger cam, and the connection of the trigger cam to the trigger pole through the flex-shaft coupler.
Figure 8:
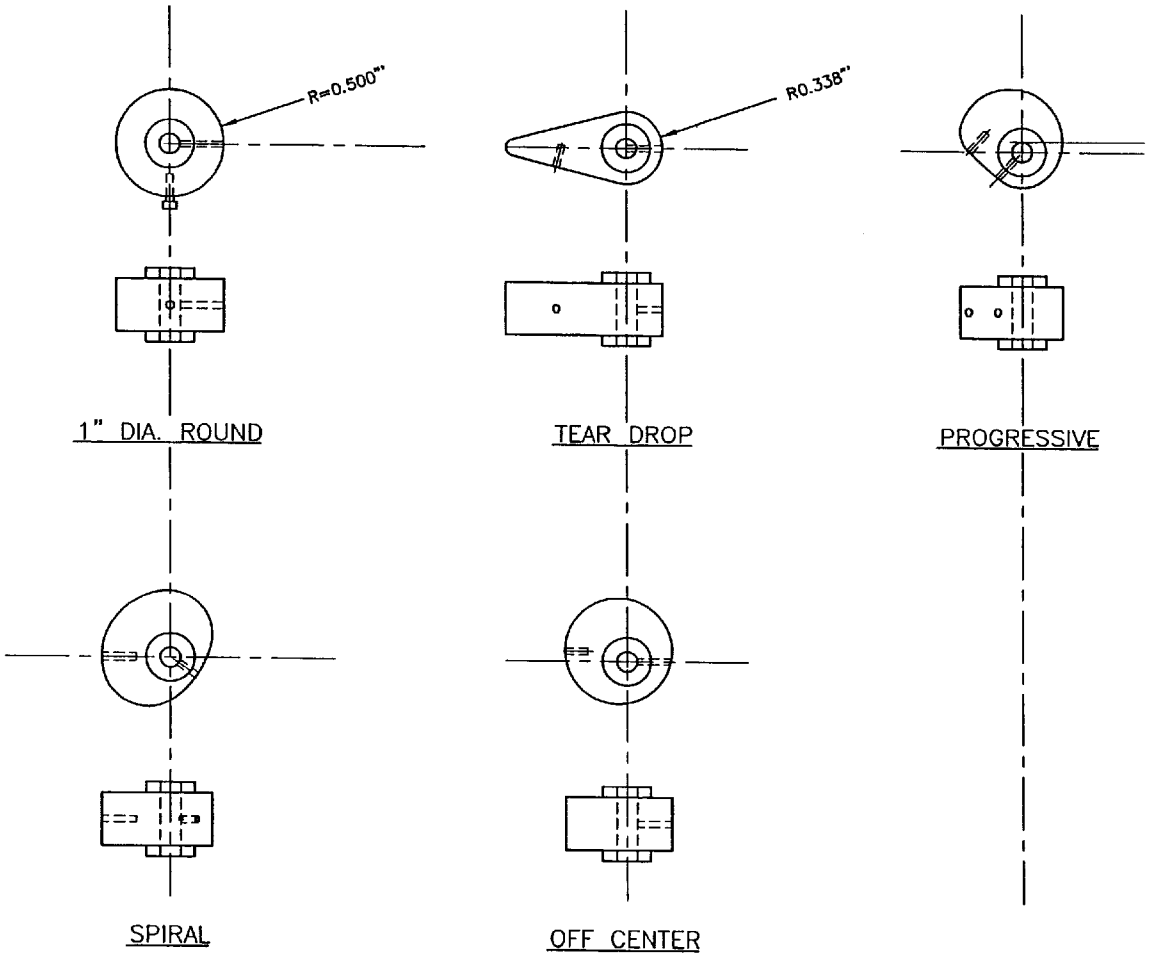
FIG. 8 shows some of the different cam shapes which can be used to match the trigger speed and force characteristics of the sprayer.
Figure 9:
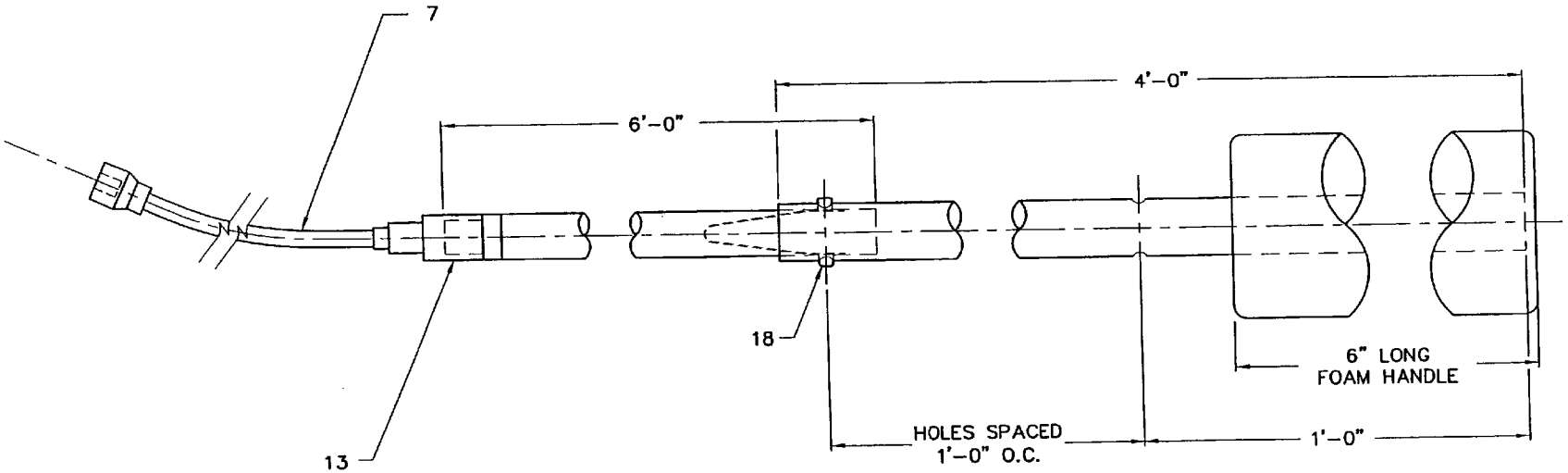
FIG. 9 shows one possible design of a telescoping trigger pole comprising several hollow telescoping sections, the total length of which is adjustable by sliding sections inside the other sections and securing the position by means of pins inserted through regularly spaced holes in the telescoping sections.

FIG. 1 shows the device being used to paint a high vertical surface. The pole harness holds the weight of the device and allows the operator to move about. The operator is gripping and rotating the adjustable trigger pole (13) to pull the trigger of the spray gun above. A standard paint pole (14) is shown attached to the device by means of the Velcro™ retainer strap (9). The trigger pull strap (8) is touching the trigger of the spray gun. When the operator below rotates the adjustable trigger pole (13) with his or her hand, the rotational motion is conveyed to the flex shaft (7) and then to the pivot shaft (6) by means of standard couplers. The trigger cam (4) is rotated by the pivot shaft (6) to which it is attached by cam set screw (5). Two nylon bushings (3) support the pivot shaft (6) in the two head ears (17). The trigger pull strap (8) is attached to trigger cam (4) by one of the strap retainer screws (12). The trigger pull strap (8) is also attached to the apparatus head (1) by additional retainer screws (12). When trigger cam (4) rotates, the trigger pull strap (8) pulls against the trigger of the spray gun, and the gun sprays. The shape of the trigger cam (4) determines how fast the trigger is pulled as the pivot shaft (6) is rotated. FIG. 2 also shows the paint extension pole (14) attached to the base (2) of the device. The head (1) can be rotated around the pivot adjuster (11) and tightened down with a wing nut to put the spray gun in proper position for spraying vertical, angled, or horizontal surfaces. FIG. 3 shows the spray gun positioned at approximate right angles to the pole (14) in order to paint the underside of horizontal surfaces. The flex shaft (7) can bend to accommodate this position, yet convey rotational motion from the adjustable trigger pole (13) to the pivot shaft (6). FIG. 4 is a perspective view of the device without the spray gun. The curved head cradle (15) into which the gun handle fits is shown in head (1), near the trigger belt (8). FIG. 5 is a view looking down on the spray gun (1) (dotted line) held in the curved cradle (15) of the head (1). It also shows how the rotation of trigger cam (4) pulls on the trigger pull strap (8), which pulls the trigger of gun (10). FIG. 6 is a back view of the head (1) holding the gun (10). It also shows the trigger cam (4) attached with cam set screw (5) to pivot shaft (6), which is coupled to flex shaft (7). The gun (10) is held securely in place by Velcro retainer strap (9). Any adjustable strap, such as a shoe lace, piece of string or a strip of rag, could be used in lieu of the Velcro retainer strap. FIG. 7 is an exploded view showing how the parts fit with the head (1). The bushings (3) are in two holes in two head ears (17) extending from head (1), and pivot shaft (6) goes inside these bushings. The pivot shaft (6) goes through trigger cam (4) and is secured to it by cam set screw (5). The trigger pull strap (8) is attached to the cam (4) by retainer screw (12), and it then extends around the gun trigger and is secured to the head (1) by retainer screws (12). FIG. 7 shows how the paint pole extender (14) and adjustable trigger pole (13) can be detached from the device for storing the device. The operator can have available several extension poles (14) of different lengths for work at different heights. FIG. 8 shows in cross section trigger cams (4) of different cross sectional shapes designed to pull the gun trigger at different rates, as the trigger pole (13) is rotated by the operator. The shape of the trigger cams (4) can be matched to the operating characteristics of the gun trigger to allow the operator fine control of the rate of spray. FIG. 9 shows one possible construction of the adjustable length trigger pole (13). The pole consists of several hollow sections which telescope into each other and are adjustable and securable by pins (18) which are inserted into regularly spaced holes in the telescoping sections of adjustable trigger pole (13).

DESCRIPTION-PREFERRED EMBODIMENT

In the preferred embodiment, a standard spray gun is attached in the curved head cradle (16) in head (1) of the device by means of the Velcro retainer strap (9). A standard paint extension pole (14) is screwed into base (2). A trigger pole (13) of adjustable length is attached to flex shaft (7). The adjustable trigger pole (13) can be made of telesccoping hollow sections secured in position by pins (18) inserted through regularly spaced holes in the telescoping sections, [or by rotating screw rings which engage the inside telescoping section, or by other adjustable means]. When the trigger pole (13) is rotated, the trigger cam (4) rotates and pulls on the trigger pull strap (8) which then, in turn, pulls on the sprayer trigger, releasing the spray.

OPERATION OF THE INVENTION

The invention is simple to operate. As shown in FIG. 4, the first step is to attach a standard spray gun to the device head (1) by inserting the gun handle in the curved cradle (16) on the device head (1). The gun handle is secured to head (1) by Velcro retainer strap (9), which is attached to the head (1) by retainer screws (12). Any shoestring, strip of rag, or common twine can be substituted by the Velcro strap if necessary. When the gun is inserted into the head (1), the gun trigger comes in contact with the outer portion of the trigger pull strap (8). The base of the apparatus (2) is attached to a standard painter extension pole (14) of desired length by screwing the pole into the base (2). The angle of the spray gun can be set by adjusting the relative positions of head (1) and base (2) by means of pivot adjuster (11), comprising of a bolt and wing nut. Next, the flex shaft (7) is attached to the adjustable length trigger pole (13) and trigger pivot shaft (6) by means of standard couplers. The flex shaft (7) can bend in order to communicate rotary motion of the pole (13) around an arc (depending upon the position of the gun (10) and pivot (11)) to the trigger cam (4). As shown in FIG. 1, the operator can rotate with his hand the trigger pole (13) so as to cause trigger cam (4) to rotate the same number of degrees. The rotating cam (4) turns around pivot shaft (6) and pulls on trigger pull strap (8), which is attached to trigger cam (4) by cam set screw (5). When the trigger pull strap (8) is pulled by the trigger cam (4), the strap (8) pulls on the spray gun trigger, thus causing the paint to spray out. The trigger pull strap (8) could be positioned on the other side of the head (1) and wrapped around trigger cam (4) in the other direction for left-handed operators. Because the flex shaft (7) can absorb twisting motion from trigger pole (13), the unique rotational movement of the trigger mechanism exerts forward pressure and stabilizing force on the gun (10) and poles (13)(14), and thereby counteracts the kickback of the sprayer when it is operated. This is important to maintain constant distance between the sprayer and the surface to be painted in order to assure a uniform thickness of paint applied on the surface. The trigger pole (13) can be adjusted to the desired length as shown in FIG. 9.

ALTERNATIVE EMBODIMENTS

Many different supports, or elongate members, could be used instead of the extension pole (14) to support the device; for example, various crane devices, including "cherry picker" cranes and remote-controlled robot arms of varying designs. Instead of the trigger pole (13), an electronically operated servomotor could be attached to the head (1) to turn the flex shaft (7) and/or pivot shaft (6).

CONCLUSIONS, RAMIFICATIONS AND SCOPE

A number of changes are possible to the device described above, while still remaining within the scope and spirit of the invention. Various materials could be used for the component parts of the device, including machined metals, molded plastic, etc. The extension pole (14) could be made of various materials, or could itself be of adjustable length by use of various means, including telescoping sections secured in place by pins (18) as in FIG. 9, [or rotating locking collars known to those skilled in the art]. The adjustable trigger pole (13) could be non-adjustable and made of one piece of various materials with length chosen for the height of the job. Other pivot means (11), including electric servo and/or gears, known to those skilled in the art, could be used to allow head (1) to rotate about base (2). The gun retainer means, the Velcro strap (9) could be replaced by various releasable straps, clamps, screws, pins, etc. [or for greatest security by a screw operated contracting band as used on radiator hoses of automobiles]. The trigger pull strap (8) could be made of various materials. The bushings (3) could be made of various materials. Flex shaft (7), or flexible connector means, could be made of various materials known to those skilled in the art, including flexible plastic or a very stiff spring. Various coupling devices, known to those skilled in the art, could be used to attach the trigger pole (13) to the flex shaft (7) and the flex shaft (7) to the pivot shaft (6). The means for engaging the extension pole (14) to base (2) could be bolts, screws, clamps, or other engaging means known to those skilled in the art. In addition, pole (14) could be permanently attached to base (2) by its end being inserted into a cavity in the base (2) and secured with various types of cement.

Various attachment means for attaching the Velcro™ retainer strap (9) to the head (1), and the trigger pull strap (8) to the head (1) and to the trigger cam (4), include various retainer screws, pins, and washers known to those skilled in the art. The trigger cam (4) can be attached by various securing means to the pivot shaft (6) by a set screw or pin, or by other connector means known to those skilled in the art.

The specifics about the form of the invention described in this application are not intended to be limiting in scope. The scope of the invention is to be determined by the claims, and their legal equivalents, not the examples given above.

We claim:

1. A device for mounting and controlling an application device with a trigger mechanism, comprising:

(a) a head to which the application device is removably attached by a retainer means;

(b) a base pivotably attached to said head by an adjustable pivot means;

(c) a trigger cam rotatably attached to the head;

(d) a trigger strap positioned to pull on the trigger of the application device and attached by an attachment means to the curved perimeter of the trigger cam;

(e) a trigger pole operatively connected to the trigger cam; and (f) whereby the rotation of said trigger pole and trigger cam causes the trigger pull strap to pull the trigger mechanism.

2. The device of claim 1, wherein said trigger cam is operationally positioned between a first and second ear of said head and behind said application device, and wherein said trigger cam is secured by a securement means to a pivot shaft positioned between the first and second ears with the shaft axis of rotation congruent with the axis of rotation of said trigger cam.

3. The device of claim 2, wherein said trigger cam is connected by a flexible connector means to said trigger pole.

4. The device of claim 3, wherein said flexible connector means comprises a elongated spring shaft.

5. The device of claim 1, wherein said attachment means for attaching said trigger pull strap to said trigger cam is a retainer screw penetrating a first end of said trigger pull strap and the curved surface of said trigger cam, and a second end of the trigger pull strap is attached to the head by a retainer screw penetrating the second end of said trigger pull strap and penetrating said head.

6. The device of claim 2, wherein said securement means for securing said trigger cam to said pivot shaft comprises a retainer screw.

7. The device of claim 6, further comprising a first and second bushing positioned respectively in the first and second ears and to which a first and second end of the pivot shaft interface.

8. The device of claim 1, wherein said trigger cam has a shape selected from the group consisting of, a round, a tear-dropped shaped, a round with an off-center axis, an oval, and an oval with an off-center axis cam.

9. A device for mounting and controlling an application device with a trigger mechanism, comprising:

(a) a head with a cradle to which the application device is attached by a retainer strap;

(b) a base pivotably attached to said head by a wing nut and screw;

(c) a rotating trigger cam rotatably mounted to the head;

(d) a trigger pull strap attached at one end to the trigger cam and the other end attached to the head such that when rotated the trigger cam will pull the tripper pull strap and this will pull the trigger of the application device attached to the head; and (e) a trigger pole operatively connected to the trigger cam and capable of rotating the trigger cam in order to operate the trigger of the application device.

* * * * *